US011170920B2

(12) United States Patent
Ohta et al.

(10) Patent No.: US 11,170,920 B2
(45) Date of Patent: Nov. 9, 2021

(54) FE-BASED NANOCRYSTALLINE ALLOY POWDER, METHOD OF PRODUCING THE SAME, FE-BASED AMORPHOUS ALLOY POWDER, AND MAGNETIC CORE

(71) Applicant: HITACHI METALS, LTD., Tokyo (JP)

(72) Inventors: Motoki Ohta, Tokyo (JP); Nobuhiko Chiwata, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/636,701

(22) PCT Filed: Aug. 6, 2018

(86) PCT No.: PCT/JP2018/029474
§ 371 (c)(1),
(2) Date: Feb. 5, 2020

(87) PCT Pub. No.: WO2019/031462
PCT Pub. Date: Feb. 14, 2019

(65) Prior Publication Data

US 2020/0373045 A1 Nov. 26, 2020

(30) Foreign Application Priority Data

Aug. 7, 2017 (JP) ..... JP2017-152108

(51) Int. Cl.
*H01F 1/153* (2006.01)
*B22F 1/00* (2006.01)
(Continued)

(52) U.S. Cl.
CPC ..... *H01F 1/15333* (2013.01); *B22F 1/0014* (2013.01); *C22C 45/02* (2013.01);
(Continued)

(58) Field of Classification Search
CPC .. H01F 1/15333; H01F 27/255; B22F 1/0014; B22F 2301/35; B22F 2304/10;
(Continued)

(56) References Cited

U.S. PATENT DOCUMENTS

2009/0065100 A1 3/2009 Yoshizawa et al.
2014/0104024 A1* 4/2014 Herzer ..... C22C 33/003 335/297
2017/0148554 A1* 5/2017 Kudo ..... H01F 1/1535

FOREIGN PATENT DOCUMENTS

JP H04-004393 B2 1/1992
JP 2007-182594 A 7/2007
(Continued)

OTHER PUBLICATIONS

English translation of International Search Report and Written Opinion for International Application No. PCT/JP2018/029474, dated Oct. 9, 2018, 5 pages.
(Continued)

*Primary Examiner* — Anthony J Zimmer
*Assistant Examiner* — Ricardo D Morales
(74) *Attorney, Agent, or Firm* — Westman, Champlin & Koehler, P.A.

(57) ABSTRACT

A Fe-based nanocrystalline alloy powder having an alloy composition represented by the following Composition Formula (1) and having an alloy structure including nanocrystal particles:

$$Fe_{100-a-b-c-d-e-f-g}Cu_aSi_bB_cMo_dCr_eC_fNb_g \quad \text{Composition Formula (1),}$$

in which 100-a-b-c-d-e-f-g, a, b, c, d, e, f, and g each represent a percent (%) by atom of a relevant element, and a, b, c, d, e, f, and g satisfy 0.10≤a≤1.10,
(Continued)

13.00≤b≤16.00, 7.00≤c≤12.00, 0.50≤d≤5.00, 0.001≤e≤1.50, 0.05≤f≤0.40, and 0≤(g/(d+g))≤0.50, in Composition Formula (1).

9 Claims, 4 Drawing Sheets

(51) Int. Cl.
*C22C 45/02* (2006.01)
*H01F 27/255* (2006.01)

(52) U.S. Cl.
CPC ..... *H01F 27/255* (2013.01); *B22F 2301/35* (2013.01); *B22F 2304/10* (2013.01); *C22C 2200/02* (2013.01); *C22C 2202/02* (2013.01)

(58) Field of Classification Search
CPC .. C22C 45/02; C22C 2200/02; C22C 2202/02
See application file for complete search history.

(56) References Cited

FOREIGN PATENT DOCUMENTS

| | | | |
|---|---|---|---|
| JP | 2013-55182 | A | 3/2013 |
| JP | 2014-136807 | A | 7/2014 |
| JP | 2017-095773 | A | 6/2017 |

OTHER PUBLICATIONS

Extended European search report for European Patent Application No. 18844142.2, dated Jan. 18, 2021, 8 pages.

* cited by examiner

FE-BASED NANOCRYSTALLINE ALLOY POWDER, METHOD OF PRODUCING THE SAME, FE-BASED AMORPHOUS ALLOY POWDER, AND MAGNETIC CORE

TECHNICAL FIELD

The present disclosure relates to a Fe-based nanocrystalline alloy powder, a method of producing the same, a Fe-based amorphous alloy powder, and a magnetic core.

BACKGROUND ART

Conventionally, Fe-based nanocrystalline alloys having an alloy composition mainly composed of Fe (e.g., a FeCuNbSiB-based alloy composition) and having a Fe-based alloy structure including nanocrystal particles are known. Fe-based nanocrystalline alloys have excellent magnetic properties such as low loss and high magnetic permeability, and therefore, they are used as materials for magnetic parts (e.g., magnetic cores) in the high frequency region.

As an example of a Fe-based nanocrystalline alloy, Patent Document 1 discloses a Fe-based soft magnetic alloy that has a specific alloy composition mainly composed of Fe, in which at least 50% of the alloy structure is composed of fine crystal particles having an average particle size of 1000 Å (100 nm) or less, and the balance is substantially amorphous. Patent Document 1 also discloses a Fe-based nanocrystalline alloy in a ribbon form (i.e., a Fe-based nanocrystalline alloy ribbon) and further discloses a production method for obtaining a Fe-based nanocrystalline alloy ribbon. According to this production method, at first, a Fe-based amorphous alloy ribbon is produced by rapidly solidifying an alloy molten metal by a liquid quenching method such as a one-roll method (also referred to as a "single roll method"). Next, the Fe-based amorphous alloy ribbon is heat-treated such that nanocrystal particles are formed in the alloy structure, thereby obtaining a Fe-based nanocrystalline alloy ribbon.

In addition, not only Fe-based nanocrystalline alloy ribbons but also Fe-based nanocrystalline alloys in a powder form (i.e., Fe-based nanocrystalline alloy powders) are known as Fe-based nanocrystalline alloys. A Fe-based nanocrystalline alloy powder is produced by preparing a Fe-based amorphous alloy in a powder form (i.e., Fe-based amorphous alloy powder), and then, heat-treating the Fe-based amorphous alloy powder, thereby forming nanocrystal particles in the alloy structure.

As an example of a method of producing a Fe-based amorphous alloy powder as a starting material (i.e., a powder before heat treatment) of a Fe-based nanocrystalline alloy powder, Patent Document 2 discloses an atomization method (e.g., a high-speed rotating water atomization method or a water atomization method) by which an alloy molten metal is made into particles, and then, the particulate alloy molten metal is rapidly solidified, thereby producing a Fe-based amorphous alloy powder.

Further, Patent Document 3 discloses a method in which an alloy molten metal is made into particles by jetting a flame jet against the alloy molten metal as another example of an atomization method.

CITATION LIST

Patent Documents

Patent Document 1: Japanese Patent Publication (JP-B) No. H4-4393

Patent Document 2: Japanese Patent Application Laid-Open (JP-A) No. 2017-95773

Patent Document 3: JP-A No. 2014-136807

SUMMARY OF INVENTION

Technical Problem

Fe-based nanocrystalline alloy powders are advantageous over Fe-based nanocrystalline alloy ribbons in that magnetic parts having various shapes (e.g., magnetic cores) can be produced by press molding or extrusion molding.

However, the particle size of crystal particles included in the alloy structure increase, which may result in reduced soft magnetic properties (e.g., increased coercive force) in Fe-based nanocrystalline alloy powders, compared to Fe-based nanocrystalline alloy ribbons.

In this regard, the following are possible reasons.

A Fe-based nanocrystalline alloy powder is produced by heat-treating a Fe-based amorphous alloy powder used as a starting material, thereby forming nanocrystal particles in the alloy structure.

A Fe-based amorphous alloy powder used as a starting material is produced by a method in which an alloy molten metal is made into particles, and then, the particulate alloy molten metal is rapidly solidified (i.e., an atomization method).

In order to produce a Fe-based nanocrystalline alloy powder having a small particle size of nanocrystal particles in the alloy structure, it is desirable to use, as a Fe-based amorphous alloy powder that is a starting material, a Fe-based amorphous alloy powder having an alloy structure consisting of an amorphous phase (i.e., an alloy structure free of crystal particles). This is because, in a case in which a Fe-based alloy powder including crystal particles is used as a starting material, subsequent heat treatment tends to coarsen the crystal particles.

In order to produce a Fe-based amorphous alloy powder having an alloy structure consisting of an amorphous phase, it is desirable to rapidly solidify an alloy molten metal to increase the cooling rate when obtaining a Fe-based amorphous alloy powder. When the cooling rate is fast, an alloy structure consisting of an amorphous phase is likely to be obtained. Meanwhile, when the cooling rate is slow, crystal particles are likely to precipitate in the alloy structure.

In this regard, in a case in which a Fe-based amorphous alloy ribbon is produced by a single roll method, it is easy to achieve a fast cooling rate. As a result, it is easy to form an alloy structure consisting of an amorphous phase. On the other hand, in a case in which a Fe-based amorphous alloy powder is produced by an atomization method, it is difficult to achieve a fast cooling rate. As a result, it is difficult to form an alloy structure consisting of an amorphous phase, and an alloy structure containing crystal particles tends to be obtained. In this regard, Reasons 1 and 2 described below are possible reasons.

(Reason 1)

In the single roll method, an alloy molten metal discharged from a molten metal nozzle is quenched when coming into contact with a cooling roll (e.g., a cooled copper alloy). Meanwhile, in the atomization method, a particulate alloy molten metal (i.e., alloy molten metal particles) is quenched when coming into contact with water.

In the atomization method, when alloy molten metal particles come into contact with water, a water vapor film is formed between particle surfaces and the water, and this water vapor film prevents heat transfer from the particles to the water. As a result, the cooling rate tends to be limited.

(Reason 2)

In the single roll method, since an alloy molten metal in a thin film state is cooled by a cooling roll, it is excellent in uniformity, and a high cooling rate is easily realized.

Meanwhile, in the atomization method, when alloy molten metal particles are formed, as it is difficult to control the size of the alloy molten metal particles, the size of the alloy molten metal particles may vary. As a result, at the stage of rapidly solidifying the alloy molten metal particles, there is a tendency that the cooling rate of small particles among all particles to be rapidly solidified increases while the cooling rate of large particles (especially the centers thereof) decreases. Accordingly, in the atomization method, there is a tendency that, among all particles constituting the obtained Fe-based amorphous alloy powder, small particles have an alloy structure consisting of an amorphous phase while large particles have an alloy structure including crystal particles.

As stated above, when producing a Fe-based amorphous alloy powder, a Fe-based alloy powder having an alloy structure including crystal particles, rather than a Fe-based amorphous alloy powder having an alloy structure consisting of an amorphous phase, may be obtained. Therefore, at the stage of heat-treating such a Fe-based alloy powder having an alloy structure including crystal particles, the crystal particles may become coarse.

As a result, in the obtained Fe-based nanocrystalline alloy powder, the particle size of crystal particles included in the alloy structure increases, and the Fe-based nanocrystalline alloy powder has reduced soft magnetic properties (e.g., increased coercive force) in some cases.

The present disclosure has been made in view of the circumstances described above.

An object of the present disclosure is to provide a Fe-based nanocrystalline alloy powder having a small particle size of nanocrystal particles in the alloy structure and excellent soft magnetic properties, a method of producing a Fe-based nanocrystalline alloy powder that is suitable for producing the Fe-based nanocrystalline alloy powder, a Fe-based amorphous alloy powder that is suitable as a starting material for the Fe-based nanocrystalline alloy powder, and a magnetic core containing the Fe-based nanocrystalline alloy powder.

Solution to Problem

Means for solving the problems includes the following aspects.

<1> A Fe-based nanocrystalline alloy powder having an alloy composition represented by the following Composition Formula (1) and having an alloy structure including nanocrystal particles:

$$Fe_{100-a-b-c-d-e-f-g}Cu_aSi_bB_cMo_dCr_eC_fNb_g \quad \text{Composition Formula (1),}$$

wherein 100-a-b-c-d-e-f-g, a, b, c, d, e, f, and g each represent a percent (%) by atom of a relevant element, and a, b, c, d, e, f, and g satisfy $0.10 \le a \le 1.10$, $13.00 \le b \le 16.00$, $7.00 \le c \le 12.00$, $0.50 \le d \le 5.00$, $0.001 \le e \le 1.50$, $0.05 \le f \le 0.40$, and $0 \le (g/(d+g)) \le 0.50$ in Composition Formula (1).

≤2> The Fe-based nanocrystalline alloy powder according to <1>, wherein d and g satisfy $0 \le (g/(d+g)) \le 0.50$ in Composition Formula (1).

<3> The Fe-based nanocrystalline alloy powder according to <1> or <2>, wherein a nanocrystal particle size D, determined by Scherrer's equation based on a peak of a diffraction plane (110) in a powder X-ray diffraction pattern of the Fe-based nanocrystalline alloy powder, is from 10 nm to 40 nm.

<4> The Fe-based nanocrystalline alloy powder according to any one of <1> to <3>, wherein a coercive force determined from a B-H curve under a condition that a maximum magnetic field is 800 A/m, is 150 A/m or less.

<5> A method of producing the Fe-based nanocrystalline alloy powder according to any one of <1> to <4>, including:

preparing a Fe-based amorphous alloy powder having an alloy composition represented by Composition Formula (1); and heat-treating the Fe-based amorphous alloy powder, thereby obtaining the Fe-based nanocrystalline alloy powder.

<6> A Fe-based amorphous alloy powder having an alloy composition represented by the following Composition Formula (1):

$$Fe_{100-a-b-c-d-e-f-g}Cu_aSi_bB_cMo_dCr_eC_fNb_g \quad \text{Composition Formula (1),}$$

wherein 100-a-b-c-d-e-f-g, a, b, c, d, e, f, and g each represent a percent (%) by atom of a relevant element, and a, b, c, d, e, f, and g satisfy $0.10 \le a \le 1.10$, $13.00 \le b \le 16.00$, $7.00 \le c \le 12.00$, $0.50 \le d \le 5.00$, $0.001 \le e \le 1.50$, $0.05 \le f \le 0.40$, and $0 \le (g/(d+g)) \le 0.50$ in Composition Formula (1).

<7> A magnetic core containing the Fe-based nanocrystalline alloy powder according to any one of <1> to <4>.

<8> The magnetic core according to <7>, wherein a core loss P, under conditions that a frequency is 2 MHz and a magnetic field strength is 30 mT, is 5000 kW/m$^3$ or less.

Advantageous Effects of Invention

According to the disclosure, a Fe-based nanocrystalline alloy powder having a small particle size of nanocrystal particles in the alloy structure and excellent soft magnetic properties, a method of producing a Fe-based nanocrystalline alloy powder that is suitable for producing the Fe-based nanocrystalline alloy powder, a Fe-based amorphous alloy powder that is suitable as a starting material for the Fe-based nanocrystalline alloy powder, and a magnetic core containing the Fe-based nanocrystalline alloy powder are provided.

DESCRIPTION OF EMBODIMENTS

Figure 1A:
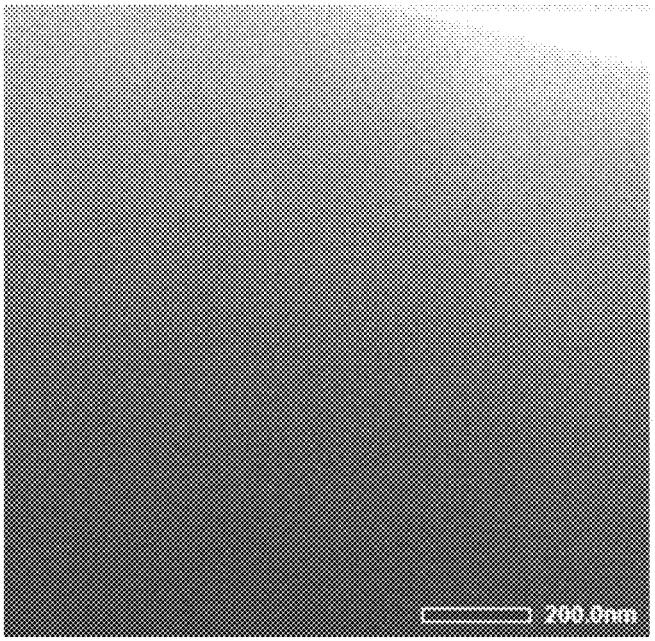
FIG. 1A is a transmission electron microscope image (TEM image) of a cross-section of a Fe-based amorphous alloy powder (Example 1) having the alloy composition of Alloy A.

In this specification, a numerical range indicated using "to" means a range including the numerical values described before and after "to" as the minimum value and the maximum value, respectively.

In this specification, the term "step" is not limited to an independent step, and any step is included in this term if the intended purpose of the step is achieved even when it cannot be clearly distinguished from other steps.

In this specification, the term "nanocrystalline alloy" means an alloy having an alloy structure including nanocrystal particles. The concept of "nanocrystalline alloy" encompasses not only an alloy having an alloy structure consisting of nanocrystal particles alone but also an alloy having an alloy structure including nanocrystal particles and an amorphous phase.

[Fe-Based Nanocrystalline Alloy Powder]

The Fe-based nanocrystalline alloy powder of the disclosure has an alloy composition represented by Composition Formula (1) described later, and has an alloy structure including nanocrystal particles.

In the Fe-based nanocrystalline alloy powder of the disclosure, the particle size of the nanocrystal particles in the alloy structure is small (e.g., the nanocrystal particle diameter D described later is small), and soft magnetic properties are excellent (e.g., coercive force is reduced).

The reason why such effects are obtained is considered as follows.

In general, a Fe-based nanocrystalline alloy powder is produced by allowing an alloy molten metal having a Fe-based alloy composition to be made into particles, rapidly solidifying the particulate alloy molten metal (i.e., alloy molten metal particles) to obtain a Fe-based amorphous alloy powder, and heat-treating the obtained Fe-based amorphous alloy powder to nanocrystallize at least part of the alloy structure (i.e., an amorphous phase).

Since the Fe-based nanocrystalline alloy powder of the disclosure has an alloy composition represented by Composition Formula (1), an alloy molten metal and a Fe-based amorphous alloy powder which are starting materials also have an alloy composition represented by Composition Formula (1). This is because in the process of producing a Fe-based nanocrystalline alloy powder described above, the alloy composition itself does not change substantially.

It is considered that when an alloy molten metal has an alloy composition represented by Composition Formula (1), precipitation of crystal particles is suppressed at the stage of rapidly solidifying alloy molten metal particles, resulting in obtaining a Fe-based amorphous alloy powder having an alloy structure consisting of an amorphous phase. It is considered that by heat-treating such Fe-based amorphous alloy powder having an alloy structure consisting of an amorphous phase, it is possible to obtain the Fe-based nanocrystalline alloy powder of the disclosure in which the particle size of nanocrystal particles in the alloy structure is small.

It is further considered that the Fe-based nanocrystalline alloy powder of the disclosure has excellent soft magnetic properties because the particle size of nanocrystal particles in the alloy structure is small.

The effect of suppressing precipitation of crystal particles during rapid solidification of alloy molten metal particles (i.e., an effect of forming an alloy structure consisting of an amorphous phase) is thought to be exhibited mainly by Si, B, and Mo in the alloy composition represented by Composition Formula (1) (hereinafter also referred to as the "alloy composition in the disclosure"). In a case in which the alloy composition in the disclosure includes Nb, Nb is also considered to have the effect.

The alloy composition in the disclosure will be described below.

<Alloy Composition>

The Fe-based nanocrystalline alloy powder of the disclosure has an alloy composition represented by the following Composition Formula (1) (i.e., the alloy composition in the disclosure). In addition, an alloy molten metal and a Fe-based amorphous alloy powder which are starting materials of the Fe-based nanocrystalline alloy powder of the disclosure also have the alloy composition in the disclosure.

$$Fe_{100-a-b-c-d-e-f-g}Cu_aSi_bB_cMo_dCr_eC_fNb_g \quad \text{Composition Formula (1),}$$

wherein 100-a-b-c-d-e-f-g, a, b, c, d, e, f, and g each represent a percent (%) by atom of a relevant element, and a, b, c, d, e, f, and g satisfy $0.10 \le a \le 1.10$, $13.00 \le b \le 16.00$, $7.00 \le c \le 12.00$, $0.50 \le d \le 5.00$, $0.001 \le e \le 1.50$, $0.05 \le f \le 0.40$, and $0 \le (g/(d+g)) \le 0.50$ in Composition Formula (1).

Hereinafter, the alloy composition represented by Composition Formula (1) (hereinafter also referred to as the "alloy composition in the disclosure") will be described.

Fe is an element responsible for soft magnetic properties in the alloy composition in the disclosure.

In Composition Formula (1), "100-a-b-c-d-e-f-g" indicating the content of Fe is preferably 73.00 or more (i.e., the Fe content is 73.00% by atom or more), more preferably 75.00 or more (i.e., the Fe content is 75.00% by atom or more).

When the Fe content is 73.00% by atom, a saturation magnetic flux density Bs of the Fe-based nanocrystalline alloy powder is further improved.

In the alloy composition in the disclosure, Cu is an element that becomes the nucleus of a nanocrystal particle (hereinafter also referred to as "nanocrystal nucleus") when a Fe-based amorphous alloy powder is heat-treated to obtain a Fe-based nanocrystalline alloy powder.

In Composition Formula (1), "a" indicating the Cu content satisfies $0.10 \le a \le 1.10$. In other words, the Cu content is from 0.10% by atom to 1.10% by atom.

Since the Cu content is 0.10% by atom or more, the function of Cu described above is effectively exhibited. The Cu content is preferably 0.30% by atom or more, more preferably 0.50% by atom or more.

Meanwhile, in a case in which the Cu content exceeds 1.10% by atom, there is a high possibility that nanocrystal nuclei exist in the Fe-based amorphous alloy powder before heat treatment, and therefore, heat treatment may cause crystals to grow large starting from the nanocrystal nuclei, resulting in coarse crystal formation. Once coarse crystals are formed, soft magnetic properties deteriorate. Accordingly, the Cu content is 1.10% by atom or less, preferably 1.00% by atom or less.

In the alloy composition in the disclosure, Si has a function of enhancing amorphous-forming ability by coexisting with B when an alloy molten metal is quenched. Si also has a function of forming a (Fe—Si) bcc phase which is a nanocrystal phase together with Fe by heat treatment.

In Composition Formula (1), "b" indicating the Si content satisfies $13.00 \le b \le 16.00$. In other words, the Si content is from 13.00% by atom to 16.00% by atom.

Since the Si content is 13.00% by atom or more, the function of Si described above is effectively exhibited. As a result, low saturation magnetostriction can be achieved in the nanocrystalline alloy powder after heat treatment. The Si content is preferably 13.20% by atom or more.

Meanwhile, in a case in which the Si content exceeds 16.00% by atom, as the viscosity of an alloy molten metal decreases, it may be difficult to control the particle size of the alloy powder. Accordingly, the Si content is 16.00% by atom or less. The Si content is preferably 14.00% by atom or less.

In the alloy composition in the disclosure, B has a function of allowing an amorphous phase to be stably formed when the alloy molten metal is quenched.

In Composition Formula (1), "c" indicating the B content satisfies $7.00 \leq c \leq 12.00$. In other words, the B content is from 7.00% by atom to 12.00% by atom.

Since the B content is 7.00% by atom or more, the function of B described above is effectively exhibited. The B content is preferably 8.00% by atom or more.

Meanwhile, in a case in which the B content exceeds 12.00% by atom, in the alloy structure after heat treatment, the volume fraction of an amorphous phase excessively increases as compared to a phase consisting of nanocrystal particles (hereinafter also referred to as "nanocrystal phase"), which may result in excessively high saturation magnetostriction. Accordingly, the B content is 12.00% by atom or less, preferably 10.00% by atom or less.

Here, the saturation magnetostriction of the (Fe—Si) bcc phase as the nanocrystalline phase is negative, whereas the saturation magnetostriction of the amorphous phase is positive, and the saturation magnetostriction of the entire alloy is determined from the ratio of the two.

The saturation magnetostriction is preferably $5\times10^{-6}$ or less, more preferably $2\times10^{-6}$ or less.

In the alloy composition in the disclosure, Mo has a function of allowing an amorphous phase to be stably formed when the alloy molten metal is quenched.

Mo also has a function of allowing nanocrystal particles having small particle sizes and a reduced particle size variation to be formed when a Fe-based amorphous alloy powder is heat-treated, thereby forming nanocrystal particles.

The reason why such functions of Mo are exhibited is unclear, but is presumed as follows.

When an alloy molten metal is quenched and when a Fe-based amorphous alloy powder is heat-treated, Mo is considered to have a property of being unlikely to migrate while being uniformly present in particles (e.g., not easily concentrated near the surfaces of particles). It is considered that the above-described functions of Mo, which are the function of allowing an amorphous phase to be stably formed when an alloy molten metal is quenched and the function of allowing nanocrystal particles having small particle sizes and a reduced particle size variation to be formed when a Fe-based amorphous alloy powder is heat-treated, thereby form nanocrystal particles, are exhibited because of such property.

In Composition Formula (1), "d" indicating the Mo content satisfies $0.50 \leq d \leq 5.00$. In other words, the Mo content is from 0.50% by atom to 5.00% by atom.

Since the Mo content is 0.50% by atom or more, the functions of Mo are effectively exhibited. The Mo content is preferably 0.80% by atom or more.

Meanwhile, in a case in which the Mo content exceeds 5.00% by atom, there is a risk that soft magnetic properties may deteriorate. Accordingly, the Mo content is 5.00% by atom or less. The Mo content is preferably 3.50% by atom or less.

In the alloy composition in the disclosure, Cr has a function of preventing rust (e.g., rust caused by moisture such as water vapor) generated at the stage of allowing an alloy molten metal to be made into particles and/or at the stage of rapidly solidifying alloy molten metal particles.

In Composition Formula (1), "e" indicating the Cr content satisfies $0.001 \leq e \leq 1.50$. In other words, the Cr content is from 0.001% by atom to 1.50% by atom.

Since the Cr content is 0.001% by atom or more, the function of Cr is effectively exhibited. The Cr content is preferably 0.010% by atom or more, more preferably 0.050% by atom or more.

Meanwhile, Cr does not contribute to the improvement of the saturation magnetic flux density. Rather, in a case in which the Cr content is excessively high, soft magnetic properties may deteriorate. Therefore, the Cr content is 1.50% by atom or less. The Cr content is preferably 1.20% by atom or less, more preferably 1.00% by atom or less.

In the alloy composition in the disclosure, C has functions of stabilizing viscosity of an alloy molten metal and suppressing a variation in the particle size of alloy molten metal particles, thereby suppressing a variation in the particle size of a Fe-based amorphous alloy powder and a variation in the particle size of a Fe-based nanocrystalline alloy powder.

In Composition Formula (1), "f" indicating the C content satisfies $0.05 \leq f \leq 0.40$. In other words, the C content is from 0.05% by atom to 0.40% by atom.

Since the C content is 0.05% by atom or more, the functions of C are effectively exhibited. The C content is preferably 0.10% by atom or more, more preferably 0.12% by atom or more.

Meanwhile, the C content is 0.40% by atom or less. The C content is preferably 0.35% by atom or less, more preferably 0.30% by atom or less.

In the alloy composition in the disclosure, Nb is an optional element. In other words, the Nb content in the alloy composition in the disclosure may be 0% by atom.

Nb has functions similar to those of Mo. Therefore, the Nb content may exceed 0%.

In Composition Formula (1), "g" indicating the Nb content and "d" indicating the Mo content satisfy $0 \leq (g/(d+g)) \leq 0.50$.

In other words, the alloy composition in the disclosure does not contain Nb, or in a case in which it contains Nb, the ratio of the percent (%) by atom of Nb to the total of the percent (%) by atom of Nb and the percent (%) by atom of Mo is 0.50 or less. Accordingly, the functions of Mo described above are effectively exhibited. More specifically, although the functions of Nb and those of Mo are similar, Mo is considered to have a property of being less likely to be concentrated near the surfaces of alloy molten metal particles than Nb. Therefore, Mo is considered to have an excellent function of allowing an amorphous phase to be stably formed when an alloy molten metal is quenched, compared to Nb.

Accordingly, by satisfying $0 \leq (g/(d+g)) \leq 0.50$, it is possible to stably form an amorphous phase when quenching an alloy molten metal. This makes it possible to reduce the particle size of nanocrystal particles in a Fe-based nanocrystalline alloy powder obtained by heat treatment.

It is preferable for g and d to satisfy $0.50 \leq (d+g) \leq 5.00$.

The Fe-based nanocrystalline alloy powder of the disclosure may contain at least one impurity element, in addition to the alloy composition in the disclosure. An impurity element described herein means an element other than each element described above.

When the entire alloy composition in the disclosure is 100% by atom, the total content of impurity elements with respect to the entire alloy composition in the disclosure (100% by atom) is preferably 0.20% by atom or less, more preferably 0.10% by atom or less.

In Composition Formula (1), d and g may satisfy $0 \leq (g/(d+g)) \leq 0.50$. In other words, the Nb content may exceed 0% by atom.

In a case in which d and g satisfy $0 < (g/(d+g)) \leq 0.50$ in Composition Formula (1), which means that the Nb content exceeds 0% by atom, core loss under high frequency (e.g., 2 MHz) conditions is further reduced in a magnetic core containing a Fe-based nanocrystalline alloy powder. In addition, in a case in which d and g satisfy $0 < (g/(d+g)) \leq 0.50$, variations in the particle size of nanocrystal particles in a Fe-based nanocrystalline alloy powder obtained by heat treatment can be suppressed.

<Nanocrystal Particle Size D>

As described above, the particle size of nanocrystal particles in the alloy structure of the Fe-based nanocrystalline alloy powder of the disclosure is small.

The following nanocrystal particle size D is an index of the particle size of nanocrystal particles in the alloy structure. The smaller the value of nanocrystal particle size D, the smaller the particle size of nanocrystal particles in the alloy structure.

In the Fe-based nanocrystalline alloy powder of the disclosure, the nanocrystal particle size D determined by Scherrer's equation based on a peak of a diffraction plane (110) in a powder X-ray diffraction pattern of the Fe-based nanocrystalline alloy powder is preferably from 10 nm to 40 nm.

In a case in which the nanocrystal particle size D is 10 nm or more, excellent reproducibility of nanocrystallization is achieved when heat treating a Fe-based amorphous alloy powder to obtain the Fe-based nanocrystalline alloy powder of the disclosure.

In a case in which the nanocrystal particle size D is 40 nm or less, the Fe-based nanocrystalline alloy powder has improved soft magnetic properties (e.g., coercive force is further reduced).

The nanocrystal particle size D is more preferably from 20 nm to 40 nm, and further preferably from 25 nm to 40 nm.

The Scherrer's equation is as follows.

$$\text{Nanocrystal particle size } D=(0.9\times\lambda)/(\beta\times\cos\theta) \quad \text{Scherrer's equation}$$

In the equation, $\lambda$ represents the wavelength of X-ray, $\beta$ represents the full width at half maximum (radian angle) of the peak of a diffraction plane (110), and $\theta$ represents the Bragg angle of the peak of the diffraction plane (110).

Here, the peak of the diffraction plane (110) is a peak having a diffraction angle $2\theta$ of around 53°.

The peak of the diffraction plane (110) is the peak of the (Fe—Si) bcc phase.

<Coercive Force Hc>

As described above, the Fe-based nanocrystalline alloy powder of the disclosure has excellent soft magnetic properties. For example, the coercive force is reduced.

The coercive force is one of the soft magnetic properties.

In the Fe-based nanocrystalline alloy powder of the disclosure, coercive force Hc determined from a B-H curve under conditions that the maximum magnetic field is 800 A/m is preferably 150 A/m or less, more preferably 120 A/m or less.

The lower limit of coercive force Hc is not particularly limited, but the lower limit is, for example, 40 A/m, preferably 50 A/m.

Here, the B-H curve under conditions that the maximum magnetic field is 800 A/m means a magnetic hysteresis curve showing changes in the magnetic flux density (B) with respect to the external magnetic field (H) when the external magnetic field (H) is changed in a range of from −800 A/m to 800 A/m.

The B-H curve is measured by a vibrating sample magnetometer (VSC) using a Fe-based nanocrystalline alloy powder filled in a measurement cell as a measurement target.

[Method of Producing Fe-Based Nanocrystalline Alloy Powder (Production Method A)]

As a method of producing the Fe-based nanocrystalline alloy powder of the disclosure, the following method of producing a Fe-based nanocrystalline alloy powder (herein referred to as "Production Method A") is suitable.

Production Method A includes:

preparing a Fe-based amorphous alloy powder having an alloy composition represented by Composition Formula (1) (hereinafter also referred to as "alloy powder preparation step"); and heat-treating the Fe-based amorphous alloy powder, thereby obtaining the Fe-based nanocrystalline alloy powder of the disclosure (hereinafter also referred to as "heat treatment step").

Production Method A may include other steps if necessary.

In Production Method A, as a starting material for obtaining the Fe-based nanocrystalline alloy powder of the disclosure by heat treatment, a Fe-based amorphous alloy powder having an alloy composition represented by Composition Formula (1) is used.

As the Fe-based amorphous alloy powder has an alloy composition represented by Composition Formula (1), it has an alloy structure consisting of an amorphous phase mainly due to the functions of Si, B, and Mo. Specifically, when alloy molten metal particles are rapidly solidified to obtain the Fe-based amorphous alloy powder, precipitation of crystal particles is suppressed mainly by the functions of Si, B, and Mo, thereby making it possible to obtain an alloy structure consisting of an amorphous phase.

In Production Method A, such a Fe-based amorphous alloy powder is heat-treated, thereby obtaining a Fe-based nanocrystalline alloy powder. Thus, a Fe-based nanocrystalline alloy powder having a small particle size of nanocrystal particles can be obtained. The thus obtained Fe-based nanocrystalline alloy powder has excellent soft magnetic properties.

<Alloy Powder Preparation Step>

In the alloy powder preparation step, a Fe-based amorphous alloy powder having an alloy composition represented by Composition Formula (1) is prepared.

Here, the concept of "preparation" encompasses not only producing a Fe-based amorphous alloy powder having an alloy composition represented by Composition Formula (1) but also simply preparing a Fe-based amorphous alloy powder having an alloy composition represented by Composition Formula (1) that has been produced in advance for the heat treatment step.

As a method of producing a Fe-based amorphous alloy powder having an alloy composition represented by Composition Formula (1), a method includes allowing an alloy molten metal having an alloy composition represented by Composition Formula (1) to be made into particles and rapidly solidifying the particulate alloy molten metal, thereby obtaining a Fe-based amorphous alloy powder represented by Composition Formula (1).

During particle formation and rapid solidification, the alloy composition does not change substantially.

Thus, a Fe-based amorphous alloy powder having an alloy composition represented by Composition Formula (1) can be obtained by allowing an alloy molten metal having an alloy composition represented by Composition Formula (1) to be made into particles and rapidly solidifying the particulate alloy molten metal, thereby obtaining a Fe-based amorphous alloy powder represented by Composition Formula (1).

An alloy molten metal having an alloy composition represented by Composition Formula (1) can be obtained by an ordinary method.

For example, an alloy molten metal having an alloy composition represented by Composition Formula (1) can be obtained by introducing each of element sources constituting the alloy composition represented by Composition Formula (1) into an induction heating furnace or the like, heating each element source to the melting point of the element or more, and mixing the element sources.

Particle formation and rapid solidification of an alloy molten metal can be performed by a known atomization method.

A known atomization apparatus can be used herein. However, a jet atomization apparatus (e.g., a producing apparatus described in Patent Document 3) is suitable.

d50 of an Fe-based amorphous alloy powder, which is a particle size (i.e., median diameter) corresponding to a cumulative frequency of 50% by volume in a volume-based cumulative distribution curve obtained by a wet laser diffraction/scattering method, is preferably from 10 μm to 30 μm, more preferably from 10 μm to 25 μm.

Here, the volume-based cumulative distribution curve means a curve indicating the relationship between the particle size (μm) of a powder and the cumulative frequency (% by volume) from the small particle size side (hereinafter the same).

In a case in which d50 is 10 μm or more, more excellent producing suitability (when, for example, an alloy molten metal is made into particles) is achieved upon producing of a Fe-based amorphous alloy powder.

In a case in which d50 is 30 μm or less, more excellent producing suitability (e.g., moldability or high filling property) is achieved when producing magnetic parts (e.g., magnetic cores) using the eventually obtained Fe-based nanocrystalline alloy powder of the disclosure.

It is considered that in the process of heat-treating a Fe-based amorphous alloy powder to obtain a Fe-based nanocrystalline alloy powder, d50 does not change substantially. The same applies to d10 and d90 described later.

The d10 of a Fe-based amorphous alloy powder is preferably from 2 μm to 10 μm, more preferably from 4 μm to 10 μm, and still more preferably from 4 μm to 8 μm.

The d90 of a Fe-based amorphous alloy powder is preferably from 20 μm to 100 μm, more preferably from 30 μm to 70 μm.

Note that d10, d50, and d90 satisfy the relationship of d10<d50<d90.

Here, d10 means a particle size corresponding to a cumulative frequency of 10% by volume in the volume-based cumulative distribution curve described above.

In addition, d90 means a particle size corresponding to a cumulative frequency of 90% by volume in the volume-based cumulative distribution curve.

The d50, d10, and d90 described above can be measured using a wet laser diffraction/scattering particle size distribution measuring device (e.g., a laser diffraction/scattering particle size distribution measuring device MT3000 (wet type) produced by MicrotracBEL Corp.).

<Heat Treatment Step>

The heat treatment step is heat-treating a Fe-based amorphous alloy powder, thereby obtaining the Fe-based nanocrystalline alloy powder of the disclosure.

As a result of heat treatment in the heat treatment step, at least part of the alloy structure (amorphous phase) of the Fe-based amorphous alloy powder is nanocrystallized to form nanocrystal particles, thereby obtaining the Fe-based nanocrystalline alloy powder of the disclosure.

Heat treatment may be performed under conditions that at least part of the amorphous phase of the Fe-based amorphous alloy powder is nanocrystallized to form nanocrystal particles.

Hereinafter, preferable heat treatment conditions are described.

According to the following preferable heat treatment conditions, a Fe-based nanocrystalline alloy powder can be obtained stably with favorable reproducibility.

(1) Temperature Increase Rate (I) Since self-heating occurs during nanocrystallization, a temperature increase rate of about from 500° C. to 1000° C./hour is preferable up to a temperature at which nanocrystallization does not start (e.g., 480° C.).

(II) Thereafter, a temperature increase rate of from 50° C. to 100° C./hour is preferable up to the following nanocrystallization temperature (e.g., a constant temperature within a temperature range of from 500° C. to 550° C.).

(2) Holding Temperature (Nanocrystallization Temperature)

It is preferable that the holding temperature is from a temperature at which the first (low temperature side) exothermic peak (exothermic peak derived from nanocrystal precipitation) appears (hereinafter referred to as "$T_{x1}$") to less than a temperature at which the second (high temperature side) exothermic peak (exothermic peak derived from coarse crystal precipitation) appears (hereinafter referred to as "$T_{x2}$") when measuring a Fe-based amorphous alloy powder with a differential scanning calorimeter (DSC) (at a temperature increase rate of 20° C/minute). The holding temperature is, for example, a constant temperature in a temperature range of from 500° C. to 550° C.

(3) Holding Time

The time during which the holding temperature (nanocrystallization temperature) is maintained (holding time) is set as appropriate in consideration of the amount of an alloy powder, the temperature distribution of heat treatment equipment, the structure of heat treatment equipment, and the like.

The holding time is, for example, from 5 to 60 minutes.

(4) Temperature Decrease Rate

The rate of temperature decreases to room temperature or near 100° C. has little effects on magnetic properties of a nanocrystalline alloy powder. Therefore, it is not necessary to control the temperature decrease rate when the temperature is lowered from the holding temperature (nanocrystallization temperature). The temperature decrease rate is preferably from 200° C. to 1000° C./hour from the viewpoint of productivity.

(5) Heat Treatment Atmosphere

The heat treatment atmosphere is preferably a non-oxidizing atmosphere such as a nitrogen gas atmosphere.

<Classification Step>

It is preferable that Production Method A includes a step of classifying the Fe-based amorphous alloy powder using a sieve between the alloy powder preparation step and the heat treatment step, thereby obtaining a powder that has passed through the sieve (hereinafter also referred to as "classification step").

In an aspect in which Production Method A includes the classification step, particles larger than the opening are removed from the Fe-based amorphous alloy powder prepared in the alloy powder preparation step, and the powder consisting of particles having sizes smaller than the opening is heat-treated. Accordingly, a Fe-based nanocrystalline alloy powder having a narrow particle size distribution, which consists of particles having sizes smaller than the opening, can be obtained. The thus obtained Fe-based nanocrystalline alloy powder is more excellent in producing suitability (e.g., moldability or high filling property) when producing magnetic parts (e.g., magnetic cores).

The opening of the sieve is preferably 40 μm or less. When the sieve opening is 40 μm or less, it is easier to exclusively select an alloy powder having an alloy structure consisting of a single amorphous phase.

The mesh opening of the sieve is more preferably 25 μm or less. When the sieve opening is 25 μm or less, producing suitability (e.g., moldability or high filling property) when producing magnetic parts (e.g., magnetic cores) can be further optimized.

The lower limit of the sieve opening is not particularly limited, but it is preferably 5 μm, more preferably 10 μm.

[Fe-Based Amorphous Alloy Powder]

The Fe-based amorphous alloy powder of the disclosure has an alloy composition represented by Composition Formula (1) (i.e., the alloy composition in the disclosure).

As described above, formation of crystal particles is suppressed at the producing stage (specifically, the stage of rapidly solidifying alloy molten metal particles) in the Fe-based amorphous alloy powder of the disclosure having the alloy composition represented by Composition Formula (1). As a result, the Fe-based amorphous alloy powder has an alloy structure consisting of an amorphous phase.

Therefore, the Fe-based amorphous alloy powder of the disclosure is a suitable starting material for the Fe-based nanocrystalline alloy powder of the disclosure.

[Magnetic Core]

The magnetic core of the disclosure contains the Fe-based nanocrystalline alloy powder of the disclosure described above.

Since the magnetic core of the disclosure contains the Fe-based nanocrystalline alloy powder of the disclosure that has excellent soft magnetic properties, core loss is reduced.

In the magnetic core of the disclosure, for example, the core loss under conditions that the frequency is 2 MHz and the magnetic field strength is 30 mT is 5000 $kW/m^3$ or less.

As described above, in a case in which d and g satisfy $0<(g/(d+g))\leq 0.50$ in Composition Formula (1), which means that the Nb content exceeds 0% by atom, core loss under high frequency (e.g., 2 MHz) conditions is further reduced in the magnetic core containing the Fe-based nanocrystalline alloy powder.

In a case in which d and g satisfy $0<(g/(d+g))\leq 0.50$ in Composition Formula (1), the core loss of the magnetic core of the disclosure under conditions that the frequency is 2 MHz and the magnetic field strength is 30 mT is, for example, 4300 $kW/m^3$ or less, preferably 4100 $kW/m^3$ or less, more preferably 4007 $kW/m^3$ or less.

It is preferable that the magnetic core of the disclosure further contains a binder for binding the Fe-based nanocrystalline alloy powder.

The binder is preferably at least one selected from the group consisting of epoxy resins, unsaturated polyester resins, phenol resins, xylene resins, diallyl phthalate resins, silicone resins, polyamideimides, polyimides, and water glass.

The binder content in the magnetic core of the disclosure with respect to 100 parts by mass of the Fe-based nanocrystalline alloy powder is preferably from 1 part by mass to 10 parts by mass, more preferably from 1 part by mass to 7 parts by mass, and further preferably from 1 part by mass to 5 parts by mass.

When the binder content is 1 part by mass or more, quality of insulation between particles and magnetic core strength are further improved.

When the binder content is 10 parts by mass or less, magnetic properties of the magnetic core are further improved.

The shape of the magnetic core of the disclosure is not particularly limited, and it can be selected as appropriate according to the purpose.

Examples of the shape of the magnetic core of the disclosure include a ring shape (e.g., an annular shape or a rectangular frame shape) and a rod shape.

A magnetic core having an annular shape is also referred to as "toroidal core."

The magnetic core of the disclosure can be produced by, for example, the following method.

A kneaded product obtained by kneading the Fe-based nanocrystalline alloy powder of the disclosure and a binder is molded using a press or the like, thereby obtaining a molded body. The kneaded product may further contain a lubricant such as zinc stearate.

A metal composite core, which is an example of the magnetic core of the disclosure, can be produced by, for example, embedding a coil in a kneaded product of the Fe-based nanocrystalline alloy powder of the disclosure and a binder and integrally molding the kneaded product with the coil. The integral molding can be performed by known molding means such as injection molding.

In addition, the magnetic core of the disclosure may contain a different metal powder other than the Fe-based nanocrystalline alloy powder of the disclosure.

Examples of a different metal powder include soft magnetic powders. Specific examples thereof include amorphous Fe-based alloy powders, pure Fe powders, Fe—Si alloy powders, and Fe—Si—Cr alloy powders.

d50 of a different metal powder may be smaller or large than or equivalent to d50 of the Fe-based nanocrystalline alloy powder of the disclosure, and can be appropriately selected according to the purpose.

EXAMPLES

Examples of the disclosure are shown below, but the disclosure is not limited to the following Examples.

Examples 1 to 6 and Comparative Examples 1 and 2

<Preparation of Fe-Based Amorphous Alloy Powder>

Alloy molten metals having alloy compositions represented by Alloy A (Example 1), Alloy B (Example 2), Alloy C (Comparative Example 1), Alloy D (Comparative Example 2), Alloy E (Example 3), Alloy F (Example 4), Alloy G (Example 5), and Alloy H (Example 6) in Table 1 were made into particles, and the particulate alloy molten metals were rapidly solidified, thereby obtaining Fe-based amorphous alloy powders.

A producing apparatus described in Patent Document 3 (jet atomizing apparatus) was used for allowing each alloy molten metal to be made into particles and rapidly solidifying each particulate alloy molten metal.

Here, the estimated temperature of flame jet was from 1300° C. to 1600° C., and the amount of water injection was from 4 to 5 liters/minute.

TABLE 1

| | Alloy | Alloy composition (% by atom) |
|---|---|---|
| Example 1 | A | $Fe_{71.53}Cu_{0.99}Si_{13.40}B_{9.98}Mo_{2.97}Cr_{0.97}C_{0.16}$ |
| Example 2 | B | $Fe_{71.87}Cu_{0.98}Si_{13.37}B_{11.71}Mo_{1.00}Cr_{0.95}C_{0.12}$ |
| Comparative Example 1 | C | $Fe_{71.95}Cu_{0.99}Si_{13.70}B_{9.28}Nb_{2.97}Cr_{0.99}C_{0.12}$ |
| Comparative Example 2 | D | $Fe_{71.55}Cu_{0.99}Si_{13.75}SB_{11.60}Nb_{0.99}Cr_{0.95}C_{0.16}$ |
| Example 3 | E | $Fe_{72.04}Cu_{0.98}Si_{13.72}B_{8.99}Nb_{1.49}Mo_{1.50}Cr_{1.12}C_{0.16}$ |
| Example 4 | F | $Fe_{73.39}Cu_{0.99}Si_{13.66}B_{8.81}Nb_{1.00}Mo_{1.00}Cr_{1.00}C_{0.15}$ |
| Example 5 | G | $Fe_{72.88}Cu_{0.97}Si_{13.58}B_{8.99}Nb_{1.28}Mo_{1.45}Cr_{0.70}C_{0.15}$ |
| Example 6 | H | $Fe_{70.66}Cu_{0.99}Si_{15.71}B_{9.03}Nb_{1.23}Mo_{1.24}Cr_{0.99}C_{0.15}$ |

The particle size distribution of each Fe-based amorphous alloy powder obtained was measured with a particle size distribution measuring device MT3000 (wet type) (runtime: 20 seconds) produced by MicrotracBEL Corp., thereby obtaining d10, d50, and d90 for each Fe-based amorphous alloy powder.

The results are shown in Table 2.

TABLE 2

| | Alloy | d10 (μm) | d50 (μm) | d90 (μm) |
|---|---|---|---|---|
| Example 1 | A | 6 | 25 | 59 |
| Example 2 | B | 7 | 24 | 50 |
| Comparative Example 1 | C | 7 | 30 | 63 |
| Comparative Example 2 | D | 5 | 27 | 71 |
| Example 3 | E | 5 | 14 | 38 |
| Example 4 | F | 4 | 15 | 49 |
| Example 5 | G | 6 | 24 | 94 |
| Example 6 | H | 5 | 17 | 40 |

In addition, for each of Fe-based amorphous alloy powders having the alloy compositions of Alloys A and C, a cross-section (inside) of the Fe-based amorphous alloy powder (powder particle size: about 20 μm) was observed with a transmission electron microscope, thereby obtaining a transmission electron microscope observation image (TEM image).

Figure 1B:
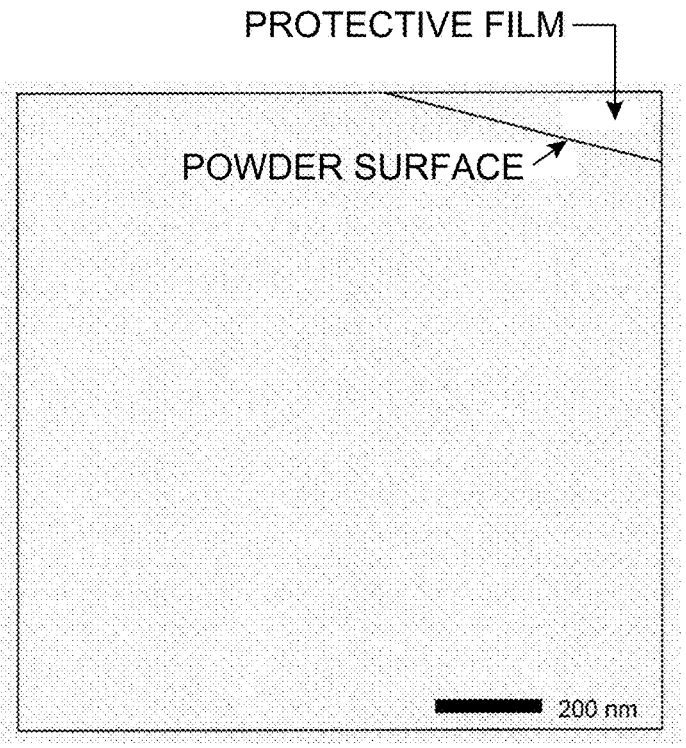
FIG. 1B is a view explaining the TEM image shown in FIG. 1A.

FIG. 1A is a transmission electron microscope image (TEM image) of a cross-section of a Fe-based amorphous alloy powder (Example 1) having the alloy composition of Alloy A. FIG. 1B is a view explaining the TEM image shown in FIG. 1A. In FIG. 1B, the term "protective film" means a protective film for TEM observation, and the term "powder surface" means the surface of an alloy particle constituting an alloy powder.

Figure 2A:
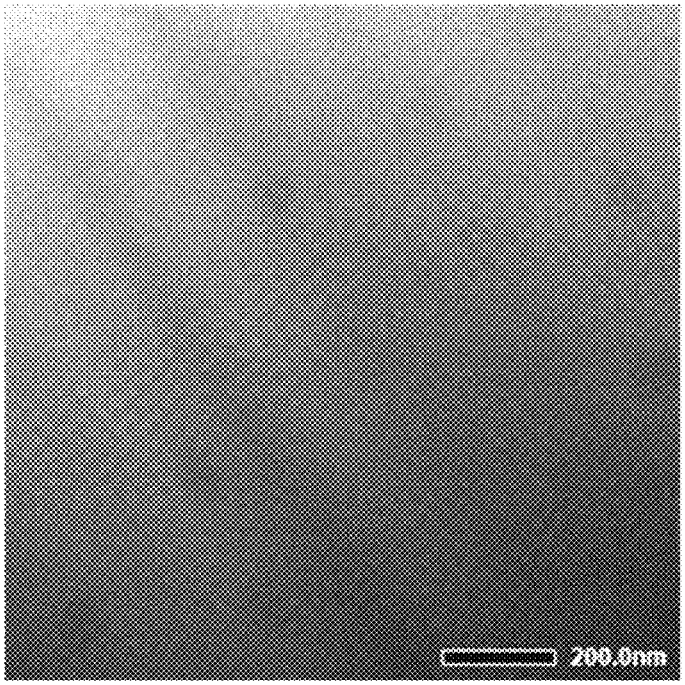
FIG. 2A is a TEM image of a cross-section of a Fe-based amorphous alloy powder (Comparative Example 1) having the alloy composition of Alloy C.
Figure 2B:
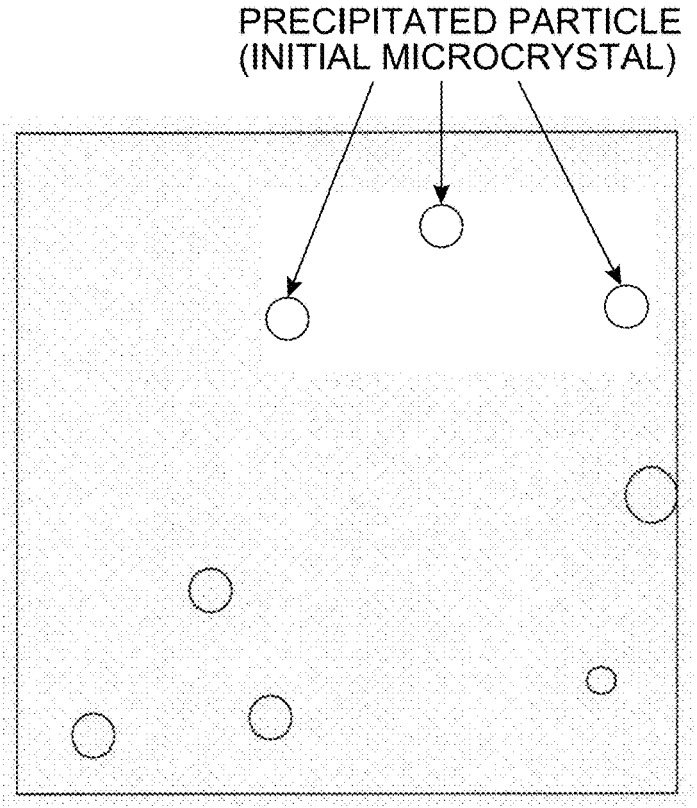
FIG. 2B is a view explaining the TEM image shown in FIG. 2A.

FIG. 2A is a TEM image of a cross-section of a Fe-based amorphous alloy powder (Comparative Example 1) having the alloy composition of Alloy C. FIG. 2B is a view explaining the TEM image shown in FIG. 2A. In FIG. 2B, the term "precipitated particle (initial microcrystal)" means a nanocrystal particle that is considered to have been formed during rapid solidification of alloy molten metal particles.

As shown in FIGS. 1A and 1B, no fine crystal particles are observed inside the amorphous alloy powder containing 2.97% by atom of Mo and having the alloy composition represented by Alloy A. Thus, it is understood that the alloy structure of this alloy powder is an alloy structure consisting of an amorphous phase.

Meanwhile, as shown in FIGS. 2A and 2B, fine crystal particles were observed inside the amorphous alloy powder containing 2.97% by atom of Nb without Mo and having the alloy composition represented by Alloy C.

<Production of Fe-Based Nanocrystalline Alloy Powder>

Each of the Fe-based amorphous alloy powders described above was classified using a sieve having an opening of 25 μm, thereby obtaining an alloy powder that passed through the sieve.

Each alloy powder that passed through the sieve was heat-treated under the following heat treatment conditions, thereby obtaining a Fe-based nanocrystalline alloy powder.

Heat treatment conditions were set such that at first, the temperature was raised to 480° C. at a temperature increase rate of 500° C./hour, the temperature was increased from 480° C. to 540° C. (holding temperature) at a temperature increase rate of 100° C./hour, the temperature was held at 540° C. (holding temperature) for 30 minutes, and then, the temperature was cooled down to room temperature in about 1 hour.

In addition, $T_{x1}$ and $T_{x2}$ of each alloy composition obtained by DSC measurement were as follows, respectively.

Alloy A: $T_{x1}$=522° C., $T_{x2}$=645° C.
Alloy B: $T_{x1}$=495° C., $T_{x2}$=552° C.
Alloy C: $T_{x1}$=530° C., $T_{x2}$=650° C.
Alloy D: $T_{x1}$=505° C., $T_{x2}$=560° C.
Alloy E: $T_{x1}$=533° C., $T_{x2}$=652° C.
Alloy F: $T_{x1}$=512° C., $T_{x2}$=648° C.
Alloy G: $T_{x1}$=527° C., $T_{x2}$=672° C.
Alloy H: $T_{x1}$=533° C., $T_{x2}$=673° C.

From these $T_{x1}$ and $T_{x2}$, it is understood that a holding temperature of 540° C. under the heat treatment conditions described above is from $T_{x1}$ to less than $T_{x2}$ in any alloy composition.

<TEM Observation of Fe-Based Nanocrystalline Alloy Powder>

For each Fe-based nanocrystalline alloy powder, a cross-section (inside) of the Fe-based nanocrystalline alloy powder (powder particle size: about 20 μm) was observed with a transmission electron microscope, thereby obtaining a transmission electron microscope observation image (TEM image).

Figure 3A:
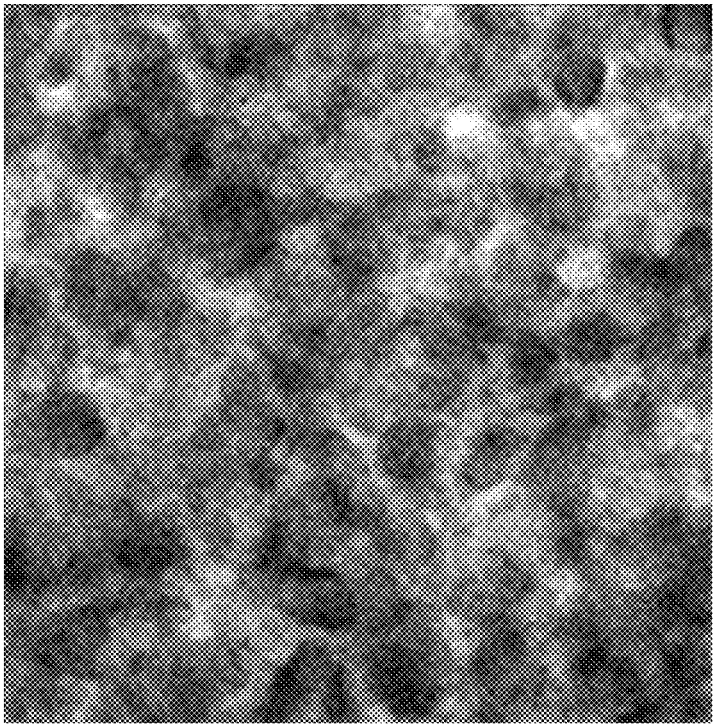
FIG. 3A is a TEM image of a cross-section of a Fe-based nanocrystalline alloy powder (Example 1) having the alloy composition of Alloy A.
Figure 3B:
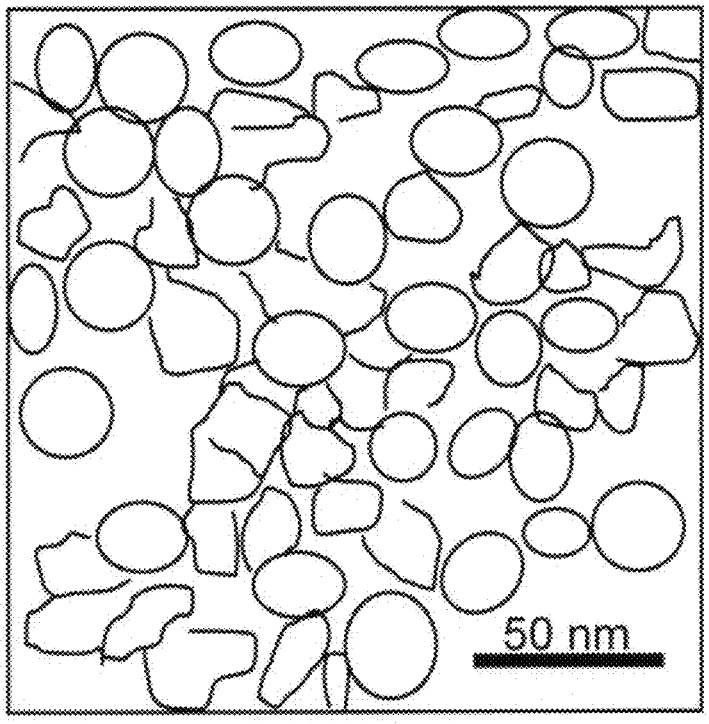
FIG. 3B is a view explaining the TEM image shown in FIG. 3A.

FIG. 3A is a TEM image of a cross-section of a Fe-based nanocrystalline alloy powder (Example 1) having the alloy composition of Alloy A. FIG. 3B is a view explaining the TEM image shown in FIG. 3A.

Figure 4A:
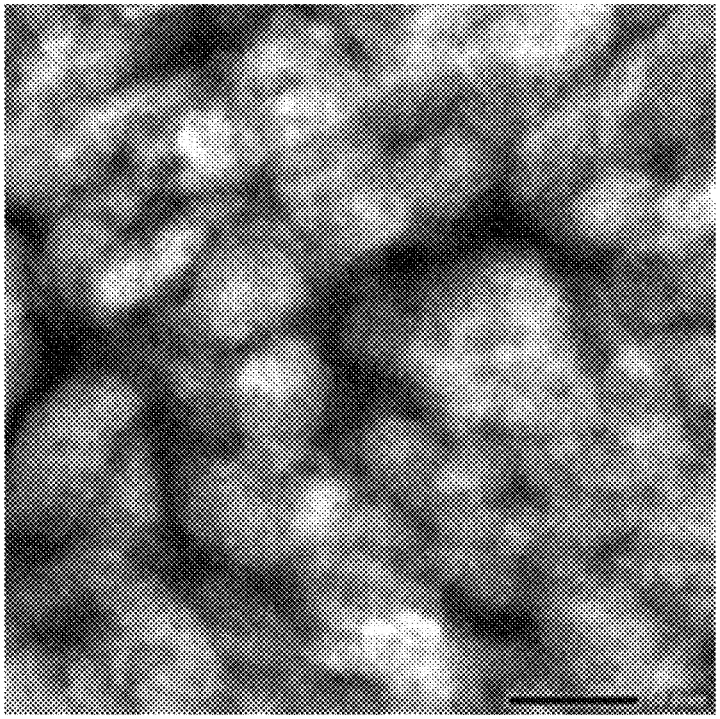
FIG. 4A is a TEM image of a cross-section of a Fe-based nanocrystalline alloy powder (Comparative Example 1) having the alloy composition of Alloy C.
Figure 4B:
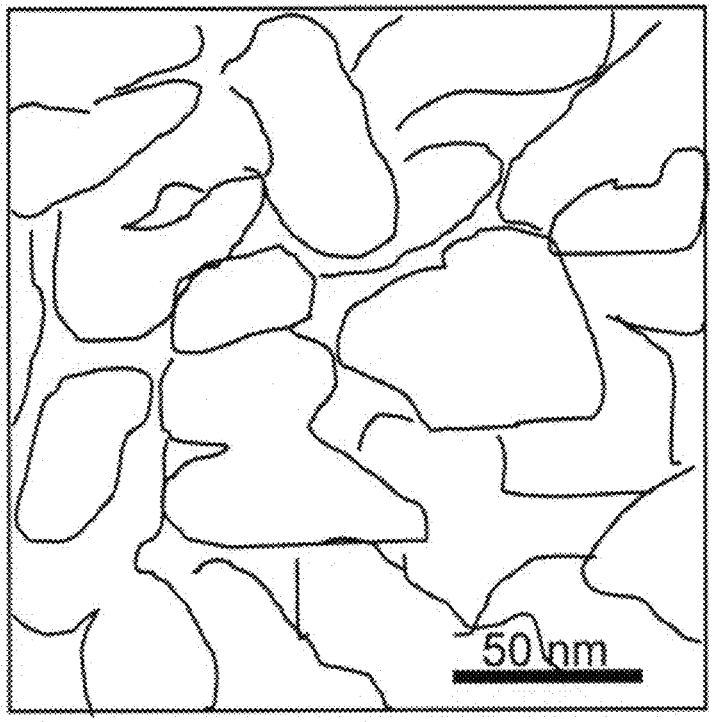
FIG. 4B is a view explaining the TEM image shown in FIG. 4A.

FIG. 4A is a TEM image of a cross-section of a Fe-based nanocrystalline alloy powder (Comparative Example 1) having the alloy composition of Alloy C. FIG. 4B is a view explaining the TEM image shown in FIG. 4A.

From FIGS. 3A, 3B, 4A, and 4B, it is understood that although the alloy structure includes nanocrystal particles in both Example 1 and Comparative Example 1, nanocrystal particles in Example 1 are obviously smaller than nanocrystal particles in Comparative Example 1.

<Measurement of Nanocrystal Particle Size D of Fe-Based Nanocrystalline Alloy Powder>

The nanocrystal particle size D of each Fe-based nanocrystalline alloy powder was measured by the method described above.

The results are shown in Table 3.

An apparatus and measurement conditions in X-ray diffraction measurement for measuring the nanocrystal particle size D were as follows.

(Apparatus)

RINT2500PC produced by Rigaku Corporation (Measurement Conditions)

X-ray source: CoKα (wavelength λ=0.1789 nm)

Scan axis: 2θ/θ

Sampling width: 0.020°

Scan speed: 2.0°/minute

Divergence slit: ½°

Vertical divergence slit: 5 mm

Scattering slit: ½°

Receiving slit: 0.3 mm

Voltage: 40 kV

Current: 200 mA

<Measurement of Coercive Force Hc of Fe-Based Nanocrystalline Alloy Powder>

Coercive force Hc of each Fe-based nanocrystalline alloy powder was measured by the method described above.

The results are shown in Table 3.

A B-H curve under conditions that the maximum magnetic field for obtaining coercive force Hc is 800 A/m was measured with a vibrating sample magnetometer (VSC).

<Preparation of Magnetic Core and Measurement of Core Loss P>

Five parts by mass of a silicone resin was added as a binder to 100 parts by mass of each Fe-based nanocrystalline alloy powder, followed by kneading. Each obtained kneaded product was molded at a pressing pressure of 1 ton/cm$^2$, thereby obtaining a ring-shaped magnetic core (i.e., toroidal core) having an outer diameter of 13.5 mm×an inner diameter of 7.7 mm×a height of 2.5 mm.

Primary and secondary side-winding wires were each wound around each obtained magnetic core 18 turns. The core loss P (kW/m$^3$) of each magnetic core in such state was measured at room temperature under conditions that the frequency was 2 MHz and the magnetic field strength was 30 mT with a B-H analyzer SY-8218 produced by IWATSU ELECTRIC CO., LTD.

The results are shown in Table 3.

TABLE 3

| | | Fe-based nanocrystalline alloy powder | | Magnetic core |
|---|---|---|---|---|
| | Alloy | Nanocrystal particle size D (nm) | Coercive force Hc (A/m) | Core loss P under conditions of 2 MHz and 30 mT (kW/m$^3$) |
| Example 1 | A | 33 | 50 | 4316 |
| Example 2 | B | 38 | 110 | 4521 |
| Comparative Example 1 | C | 61 | 220 | 7992 |
| Comparative Example 2 | D | 72 | 240 | 9874 |
| Example 3 | E | 28 | 75 | 2476 |
| Example 4 | F | 37 | 150 | 4007 |
| Example 5 | G | 29 | 97 | 3739 |
| Example 6 | H | 35 | 137 | 3707 |

As shown in Table 3, the Fe-based nanocrystalline alloy powders in Examples 1 to 6 each having the alloy composition in the disclosure (Alloys A, B, and E to H) had smaller values of nanocrystal particle size D and coercive force Hc, compared to the Fe-based nanocrystalline alloy powders in Comparative Examples 1 and 2 each having an alloy composition other than the alloy composition in the disclosure (Alloys C and D).

The reason why the nanocrystal particle size D was large in Comparative Examples 1 and 2 is considered that nanocrystal particles were already present in the alloy structure of the Fe-based amorphous alloy powder before heat treatment in Comparative Examples 1 and 2 (e.g., see FIGS. 2A and 2B for Comparative Example 1), and such crystal particles grew as a result of heat treatment.

Meanwhile, in Examples 1 to 6, crystal particles were not present in the alloy structure of the Fe-based amorphous alloy powder before heat treatment, and thus, the alloy structure was an alloy structure consisting of an amorphous phase (e.g., see FIGS. 1A and 1B for Example 1). Accordingly, in Examples 1 to 6, a Fe-based nanocrystalline alloy having an alloy structure including small nanocrystal particles (i.e., particles having a small nanocrystal particle size D) could be obtained as a result of heat treatment.

Further, as shown in Table 3, magnetic cores in Examples 1 to 6 each having the alloy composition in the disclosure (Alloys A, B, and E to H) had a decrease in the core loss P under conditions that the frequency was 2 MHz and the magnetic field strength was 30 mT, compared to the cores in Comparative Examples 1 and 2 each having an alloy composition other than the alloy composition in the disclosure (Alloys C and D).

Among Examples 1 to 6, the magnetic cores in Example 3 to 6 each having an alloy composition including both Mo and Nb (Alloys E to H) had a decrease in the core loss P under conditions that the frequency was 2 MHz and the magnetic field strength was 30 mT, compared to the magnetic cores in Examples 1 and 2 each having an alloy composition including Mo but Nb (Alloys A and B).

Next, the core loss P was measured for the magnetic cores in Examples 3 to 6 while changing the measurement conditions of core loss P to conditions that the frequency was 3 MHz and the magnetic field strength was 20 mT.

As a result, the values of core loss P under conditions that the frequency was 3 MHz and the magnetic field strength was 20 mT were 2017 kW/m$^3$ (Example 3), 3056 kW/m$^3$ (Example 4), 2994 kW/m$^3$ (Example 5), and 2876 kW/m$^3$ (Example 6), respectively.

The disclosure of Japanese Patent Application No. 2017-152108 filed on Aug. 7, 2017 is incorporated herein by reference in its entirety.

All references, patent applications, and technical standards mentioned in this specification are incorporated herein by reference to the same extent as if individual references, patent applications, and technical standards were specifically and individually stated to be incorporated by reference.

What is claimed is:

1. A Fe-based nanocrystalline alloy powder having an alloy composition represented by the following Composition Formula (1) and having an alloy structure comprising nanocrystal particles:

$$Fe_{100-a-b-c-d-e-f-g}Cu_aSi_bB_cMo_dCr_eC_fNb_g \quad \text{Composition Formula (1),}$$

wherein 100-a-b-c-d-e-f-g, a, b, c, d, e, f, and g each represent a percent (%) by atom of a relevant element, and a, b, c, d, e, f, and g satisfy $0.10 \le a \le 1.10$, $13.00 \le b \le 16.00$, $7.00 \le c \le 12.00$, $0.50 \le d \le 5.00$, $0.001 \le e \le 1.50$, $0.05 \le f \le 0.40$, and d and g satisfy $0 < (g/(d+g)) \le 0.50$;

wherein a core loss P, under conditions that a frequency is 2 MHz and a magnetic field strength is 30 mT, is 5000 kW/m$^3$ or less.

2. The Fe-based nanocrystalline alloy powder according to claim 1, wherein a nanocrystal particle size D, determined by Scherrer's equation based on a peak of a diffraction plane (110) in a powder X-ray diffraction pattern of the Fe-based nanocrystalline alloy powder, is from 10 nm to 40 nm.

3. The Fe-based nanocrystalline alloy powder according to claim 1, wherein a coercive force Hc, determined from a B-H curve under a condition that a maximum magnetic field is 800 A/m, is 150 A/m or less.

4. A method of producing the Fe-based nanocrystalline alloy powder according to claim 1, comprising:

preparing a Fe-based amorphous alloy powder having an alloy composition represented by Composition Formula (1); and heat-treating the Fe-based amorphous alloy powder, thereby obtaining the Fe-based nanocrystalline alloy powder.

5. A Fe-based amorphous alloy powder having an alloy composition represented by the following Composition Formula (1):

$$Fe_{100-a-b-c-d-e-f-g}Cu_aSi_bB_cMo_dCr_eC_fNb_g \quad \text{Composition Formula (1),}$$

wherein 100-a-b-c-d-e-f-g, a, b, c, d, e, f, and g each represent a percent (%) by atom of a relevant element, and a, b, c, d, e, f, and g satisfy $0.10 \le a \le 1.10$, $13.00 \le b \le 16.00$, $7.00 \le c \le 12.00$, $0.50 \le d \le 5.00$, $0.001 \le e \le 1.50$, $0.05 \le f \le 0.40$, and d and g satisfy $0 < (g/(d+g)) \le 0.50$;

wherein a core loss P of a magnetic core containing the Fe-based amorphous alloy powder, under conditions that a frequency is 2 MHz and a magnetic field strength is 30 mT, is 5000 $kW/m^3$ or less.

6. The Fe-based nanocrystalline alloy powder according to claim 1, wherein a nanocrystal particle size D, determined by Scherrer's equation based on a peak of a diffraction plane (110) in a powder X-ray diffraction pattern of the Fe-based nanocrystalline alloy powder, is from 10 nm to 40 nm, and wherein a coercive force Hc, determined from a B-H curve under a condition that a maximum magnetic field is 800 A/m, is 150 A/m or less.

7. A magnetic core containing the Fe-based nanocrystalline alloy powder according to claim 6.

8. A magnetic core containing the Fe-based nanocrystalline alloy powder according to claim 1, wherein the core loss P of the magnetic core is 4007 $kW/m^3$ or less.

9. A magnetic core containing the Fe-based nanocrystalline alloy powder according to claim 5, wherein the core loss P of the magnetic core is 4007 $kW/m^3$ or less.

* * * * *